US005542663A

United States Patent [19]

Kato et al.

[11] Patent Number: 5,542,663

[45] Date of Patent: Aug. 6, 1996

[54] THREAD WOUND GOLF BALL

[75] Inventors: Akira Kato, Kobe; Yoshikazu Yabuki, Akashi, both of Japan

[73] Assignee: Sumitomo Rubber Industries, Ltd., Hyogo-ken, Japan

[21] Appl. No.: 280,820

[22] Filed: Jul. 26, 1994

[30] Foreign Application Priority Data

Jul. 30, 1993 [JP] Japan ..... 5-189906

[51] Int. Cl.[6] ..... A63B 37/06; A63B 37/12

[52] U.S. Cl. ..... 473/363

[58] Field of Search ..... 273/230, 225, 273/226, 227, 222, 231

[56] References Cited

U.S. PATENT DOCUMENTS 1,080,592 12/1913 Saunders ..... 273/230 X
2,542,356 2/1951 Radford ..... 273/230

FOREIGN PATENT DOCUMENTS 2437223 9/1979 France .
16288 of 1913 United Kingdom .
1021424 12/1962 United Kingdom .

*Primary Examiner*—George J. Marlo
*Attorney, Agent, or Firm*—Birch, Stewart, Kolasch & Birch, LLP

[57] ABSTRACT

A thread wound golf ball comprising a solid center, a thread rubber layer provided on the outside of the solid center and a cover for covering the thread rubber layer, wherein said center has a strain of 0.5 to 5 mm when 500 g weight is loaded on the solid center and is composed of an inner rubber portion, and said inner rubber portion has a crosslinked rubber structure, formed from a composition comprising 100 parts by weight of a base rubber and 30 to 500 parts by weight of an oily substance, whereby bleeding of the oily substance is prevented, wherein said oily substance is selected from the group consisting of petroleum compounded oil, plasticizer, rubber substitute, alkylbenzene, liquid rubber and a mixture thereof; and wherein said oil-resistant substance is selected from the group consisting of ionomer resin, acrylonitrile-butadiene rubber, chloroprene rubber, urethane rubber, fluorosilicone rubber and a mixture thereof.

8 Claims, 1 Drawing Sheet

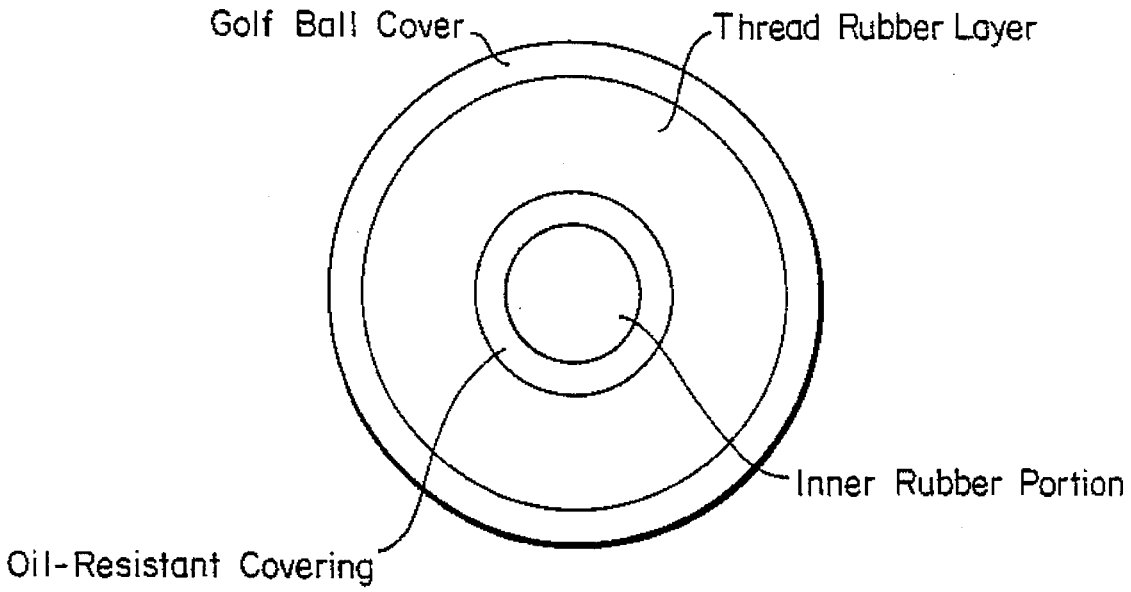
Golf Ball Cover
Thread Rubber Layer
Inner Rubber Portion
Oil-Resistant Covering

THREAD WOUND GOLF BALL

FIELD OF THE INVENTION

The present invention relates to a thread wound golf ball.

BACKGROUND OF THE INVENTION

A thread wound golf ball is obtained by winding a thread rubber on a solid or liquid rubber center to form a thread rubber layer and coating the outside of the thread rubber layer with a cover material (e.g. ionomer, balata, etc.). As the solid rubber center, a vulcanized butadiene rubber has been used in the prior art, and it has a considerably high hardness and small compression strain. In the golf ball with such a center, a spin amount is large and a launch angle is small, so that it is disadvantageous in view of flying distance. Further, the golf ball turns too much when hit the ball to control easily, sometimes.

On the other hand, a liquid center has a large compression strain. In the golf ball with such a liquid center, the spin amount is small and launch angle is large, so that it is advantageous in view of flying distance in comparison with a conventional solid center. However, in case of the liquid center, there was a problem that the production process is complicated and, further, a liquid in the liquid center is splashed when the golf ball is cut by a cutter, which results in loss of eyesight.

The present inventors have found that, by using a solid rubber having a crosslinked structure containing an oily substance as the center of the thread wound golf ball, the spin amount is reduced and launch angle is increased under a proper initial velocity, thereby improving the flying distance in case of wood and iron shot with keeping good balance (Japanese Patent Application No. 4-149304). However, the oily substance of the center causes bleeding with time to penetrate into the thread rubber layer, which results in deterioration of impact resilience. Accordingly, performances of the golf ball could not be maintained.

SUMMARY OF THE INVENTION

In order to solve the problem on bleeding of the oily substance in the thread wound golf ball with the solid rubber containing the oily substance as the center, the present inventors have intensively studied. As a result, it has been found that, by coating the outside of the solid rubber center containing the oily substance with an oil-resistant substance, bleeding can be prevented to maintain performances of the golf ball.

The main object of the present invention is to provide a thread wound golf ball wherein deterioration of performances due to bleeding of an oily substance contained in a solid rubber having a crosslinked structure as a center can be prevented.

This object as well as other objects and advantages of the present invention will become apparent to those skilled in the art from the following description.

The present invention provides a thread wound golf ball comprising a solid center, a thread rubber layer provided on the outside of the solid center and a cover for covering the thread rubber layer, wherein said solid center is composed of an inner rubber portion and an oil-resistant substance covering the inner rubber portion, and said inner rubber portion has a crosslinked rubber structure and contain an oily substance, whereby bleeding of the oily substance is prevented.

BRIEF DESCRIPTION OF THE DRAWING

The drawing shows a golf ball of the present invention.

DETAILED DESCRIPTION OF THE INVENTION

The base rubber for obtaining the inner rubber center may be any one which can be vulcanized with sulfur or peroxide, for example, there can be suitably used polybutadiene rubber (BR), natural rubber (NR), ethylene-propylene-diene monomer terpolymer rubber (EPDM), polynorbornene rubber and the like. Further, styrene, ethylene or urethane thermoplastic rubbers can also be used. In any case, it is desired that the rubber is superior in compatibility with a specific oily substance and can contain the oily substance as much as possible, and that the rubber has suitable impact resilience when a crosslinked structure is formed in the state wherein the oily substance is uniformly dispersed in the rubber.

The oily substance may be any one which exhibits fluidity, or semi-solid form at room temperature and has little volatility. Particularly, an oily substance which is superior in compatibility with the above rubber and is uniformly formulated in the rubber to cause little deterioration of impact resilience of the rubber, or an oily substance which can impart suitable impact resilience to a rubber having low impact resilience by mixing with the rubber is preferred. Examples of the oily substance include the followings.

(1) Petroleum compounded oil: It is normally used as an extender oil and is classified into the followings according to the amount of aromatic ring, naphthene ring or paraffin chain.

(i) Paraffinic oil: It contains not less than 50% of paraffin chain.

(ii) Naphthenic oil: It contains 30 to 45% of naphthenic ring carbon.

(iii) Aromatic oil: It contains not less than 35% of aromatic ring carbon.

(2) Plasticizer

Examples thereof include phthalate plasticizer such as DBP(dibutyl phthalate), DOP(dioctyl phthalate), etc.; adipate plasticizer such as DOA(dioctyl adipate), etc.; sebacate plasticizer such as DOS(dioctyl sebacate), etc.; phosphate plasticizer such as TCP(tricresyl phosphate), etc.; adipic acid plasticizer and the like.

(3) Rubber substitute (factice): It is obtained by vulcanizing a vegetable oil with sulfur or sulfur chloride and examples thereof include candy substitute, black substitute, brown substitute and the like.

(4) Alkylbenzene: Examples thereof include 1-dodecyl-4-hexylbenzene, 1-dodecyl-3-hexylbenzene, 1.3.5-methylene, 1.2.3-hemimellitene and the like.

(5) Liquid rubber: Examples thereof include liquid polybutadiene, liquid polyisoprene and the like.

These oily substances are used alone or in combination thereof.

The combination of the oily substance and base rubber is selected by taking compatibility of the oily substance with rubber into consideration. Typical examples of the suitable combination include polybutadiene or natural rubber/naphthenic oil or aromatic oil; EPDM/paraffinic oil; polynorbornene rubber/naphthenic oil, aromatic oil, plasticizer, alkylbenzene or paraffinic oil; urethane rubber/plasticizer or rubber substitute and the like.

The amount of the oily substance is preferably about 30 to 500 parts by weight, more preferably 50 to 400 parts by weight, based on 100 parts by weight of the rubber. When the amount is smaller than 30 parts by weight, no improvement effect can be obtained. On the other hand, when the amount is larger than 500 parts by weight, the oil can not be mixed with the rubber in case of a specific combination.

If necessary, fillers as specific gravity adjustors (e.g. barium sulfate, etc.), reinforcers (e.g. water-containing silicic acid, carbon black, etc.), processing aids as tackifiers, antioxidants, etc. can be added to the inner rubber center, in addition to the base rubber and oily substance. When the sulfur vulcanization is conducted, sulfur, zinc oxide, stearic acid, vulcanization accelerator, zinc stearate, etc. are added as a vulcanization agent and, when the peroxide vulcanization is conducted, organic peroxide (e.g. dicumyl peroxide, 1,1-di-t-butylperoxy- 3,3,5-trimethylcyclohexane, etc.), activator (e.g. zinc stearate, etc.), zinc oxide, co-crosslinking agent (e.g. zinc acrylate, zinc methacrylate, N,N'-m-phenylene dimaleimide, etc.), etc. are added in a suitable amount to give a vulcanizable rubber composition.

In the present invention, the above-described inner rubber center is coated with a specific material to form a solid center. The material for coating the inner rubber center part may be any one which prevents bleeding of the oily substance contained in the inner rubber center, and there can be normally used an oil-resistant substance having flexibility, such as thermoplastic resin, oil-resistant rubber and the like. Typical examples thereof include ionomer resin, NBR, chloroprene rubber, urethane rubber, fluorosilicone rubber and the like. However, it is necessary to coat them without deterioration of physical properties of the inner rubber center. A thickness of the substance is not specifically limited, but it is 0.01 to 5 mm, preferably 0.1 to 2 mm.

In the present invention, the inner rubber composition is molded in a die in advance by a compression molding, injection molding and the like. Thereafter, the resulting inner center is coated with an oil-resistant substance and subjected to a compression molding or injection molding to obtain a solid center having a predetermined size. Then, a thread rubber for golf ball is wound on the resulting center to form a thread wound center comprising a center and a thread rubber layer, on which a half-shell of a cover material comprising an ionomer resin or balata (transpolyisoprene) as a main component is coated, followed by molding in a die provided with dimples to obtain a desired golf ball.

If the solid center obtained according to the present invention has not suitable impact resilience, an initial velocity in case of ball hitting becomes low, which results in small flying distance. When the impact resilience of the solid center is represented by the height of the rebound obtained by dropping the solid center on a rigid plane such as concrete block from the height of 254 cm (100 in.) at 23° C., the value of the height is preferably not more than 70 cm. When the value is smaller than 70 cm, the initial velocity of the golf ball becomes too low, so that it becomes difficult to enable the solid center to exhibit the effect thereof. It is necessary that strain on loading of 500 g weight of the solid center is preferably not less than 0.5 mm, more preferably 1 to 5 mm. When the strain is smaller than the above range, the spin amount in case of hitting becomes large and, at the same time, hit feeling becomes inferior.

Further, the outer diameter of the solid center is normally 23 to 34 mm, preferably 26 to 32 mm. When the outer diameter is smaller than 23 mm, the spin amount becomes large and launch angle becomes small. On the other hand, when the outer diameter is larger than 34 mm, the thread rubber layer becomes thin and the predetermined hardness of the golf ball can not be obtained.

According to the present invention, bleeding of the oily substance contained in the solid center is prevented, thereby causing no deterioration of performances of the golf ball. Further, an excellent golf ball wherein the effect obtained by formulating the oily substance in the inner rubber center (e.g. reduction of spin, improvement of balance of flying distance in case of wood or iron shot, etc.) is maintained can be obtained.

EXAMPLES

The following Examples and Comparative Examples further illustrate the present invention in detail but are not to be construed to limit the scope thereof.

Examples 1 to 4 and Comparative Examples 1 to 3

Each formulation shown in Table 1 was subjected to compression molding/vulcanization at 155° C. for 20 minutes to form an inner rubber center, respectively. Then, the rubber centers (Examples 1 and 3) and rubber center (Example 2) were coated with an ionomer resin of 0.1 mm in thickness and an ionomer resin of 0.2 mm in thickness, respectively, and then subjected to compression molding to obtain solid centers. Further, the rubber center of Example 4 was coated with a non-vulcanized rubber comprising a formulation shown in Table 2 (thickness: 1 mm), and then subjected to compression molding/vulcanization to obtain a center. Then, a thread wound golf ball with an ionomer cover was produced using the resulting center. The initial flying performances and the flying performances after 6 months of the resulting golf ball were evaluated by a normal method. The results are shown in Table 3.

TABLE 1

| | Example No. | | | | Comparative Example No. | | |
|---|---|---|---|---|---|---|---|
| | 1 | 2 | 3 | 4 | 1 | 2 | 3 |
| Norsolex *1 | 100 | 100 | 100 | 100 | — | 100 | 100 |
| Sansen 255ZJ *2 | 200 | 200 | 300 | 200 | — | 200 | 300 |
| BR11 *3 | — | — | — | — | 100 | — | — |
| Sulfur | 2 | 2 | 2 | 2 | 10 | 2 | 2 |
| Zinc white | 5 | 5 | 5 | 5 | 5 | 5 | 5 |
| Stearic acid | 2 | 2 | 2 | 2 | 2 | 2 | 2 |
| Barium sulfate | 245 | 255 | 330 | 280 | 75 | 240 | 320 |
| Noxxelar CZ *4 | — | — | — | — | 1.5 | — | — |
| Noxxelar TT *5 | 0.8 | 0.8 | 0.8 | 0.8 | 0.2 | 0.8 | 0.8 |
| Noxxelar M *6 | 0.8 | 0.8 | 0.8 | 0.8 | — | 0.8 | 0.8 |
| Noxxelar TBT-N *7 | 1.2 | 1.2 | 1.2 | 1.2 | — | 1.2 | 1.2 |
| Sanselar TE-G *8 | 0.4 | 0.4 | 0.4 | 0.4 | — | 0.4 | 0.4 |

*1: Trade name, polynorbornene rubber manufactured by Nippon Zeon Co., Ltd.
*2: Trade name, naphthenic oil manufactured by Nihon San Sekiyu Co., Ltd.
*3: Trade name, butadiene rubber manufactured by Japan Synthetic Rubber Co., Ltd.
*4: Trade name, manufactured by Ohuchi Shinko Kagaku Co., Ltd.
*5: Trade name, manufactured by Ohuchi Shinko Kagaku Co., Ltd.
*6: Trade name, manufactured by Ohuchi Shinko Kagaku Co., Ltd.
*7: Trade name, manufactured by Ohuchi Shinko Kagaku Co., Ltd.
*8: Trade name, manufactured by Sanshin Kagaku Co., Ltd.

TABLE 2

| | |
|---|---|
| N230S *8 | 100 |
| Zinc oxide | 5 |
| Stearic acid | 1.5 |
| FEF Black | 20 |

TABLE 2-continued

| | |
|---|---|
| FT Black | 30 |
| DOP | 10 |
| Antioxidant OD | 1.5 |
| Vulcanization accelerator CZ | 1.5 |
| Sulfur | 0.3 |

*8: Trade name, NBR manufactured by Japan Synthetic Rubber Co., Ltd.

the resulting golf ball were evaluated by a normal method. The results are shown in Table 5.

TABLE 3

| | | | Example No. | | | | Comparative Example No. | | |
|---|---|---|---|---|---|---|---|---|---|
| | | | 1 | 2 | 3 | 4 | 1 | 2 | 3 |
| Ball center | Inner center (mm) | | 30.0 | 30.0 | 30.0 | 28.2 | 30.0 | 30.0 | 30.0 |
| | Outer diameter (mm) | | 30.2 | 30.4 | 30.2 | 30.2 | 30.0 | 30.0 | 30.0 |
| | Weight (g) | | 20.9 | 20.5 | 20.3 | 20.4 | 20.5 | 20.5 | 20.4 |
| | Compression strain (1) (mm) | | 1.3 | 1.1 | 2.5 | 1.7 | 0.4 | 1.5 | 2.7 |
| | Impact resilience (cm) | | 110 | 105 | 107 | 95 | 215 | 125 | 120 |
| Ball | Weight (g) | | 45.5 | 45.3 | 45.2 | 45.3 | 45.4 | 45.3 | 45.4 |
| | Compression (2) | Beginning | 78 | 78 | 77 | 79 | 78 | 78 | 79 |
| | | After 6 months | 78 | 78 | 77 | 79 | 78 | 75 | 75 |
| Flying perform-ances 1 | Launch angle (°) (3) | Beginning | 11.6 | 11.4 | 11.8 | 11.5 | 10.5 | 11.8 | 12.0 |
| | | After 6 months | 11.7 | 11.4 | 11.8 | 11.6 | 10.6 | 10.8 | 11.1 |
| | Spin (rpm) (3) | Beginning | 3150 | 3180 | 3100 | 3150 | 3300 | 3050 | 2950 |
| | | After 6 months | 3150 | 3200 | 3050 | 3100 | 3400 | 3300 | 3250 |
| | Carry (yard) (3) | Beginning | 224.5 | 223.5 | 223.0 | 222.0 | 218.5 | 224.5 | 224.0 |
| | | After 6 months | 224.0 | 223.5 | 223.5 | 223.0 | 218.0 | 220.5 | 220.0 |
| | Total (yard) (3) | Beginning | 228.0 | 225.5 | 226.0 | 225.5 | 221.5 | 228.5 | 228.0 |
| | | After 6 months | 228.5 | 227.5 | 227.5 | 226.0 | 221.0 | 223.5 | 224.0 |
| Flying perform-ances 2 | Launch angle (°) (4) | Beginning | 14.8 | 14.6 | 15.1 | 14.8 | 14.1 | 15.0 | 15.2 |
| | | After 6 months | 15.1 | 14.7 | 15.2 | 14.8 | 14.3 | 13.9 | 14.0 |
| | Spin (rpm) (4) | Beginning | 3920 | 4000 | 3950 | 4010 | 4400 | 3900 | 3850 |
| | | After 6 months | 4010 | 4150 | 3990 | 4000 | 4500 | 4300 | 4350 |
| ances | Carry (yard) (4) | Beginning | 178.0 | 176.5 | 176.0 | 175.0 | 172.0 | 178.0 | 177.5 |
| | | After 6 months | 177.5 | 176.5 | 176.0 | 174.0 | 171.0 | 173.5 | 173.0 |
| | Total (yard) (4) | Beginning | 185.0 | 184.0 | 184.0 | 183.0 | 179.0 | 185.0 | 184.0 |
| | | After 6 months | 184.0 | 183.0 | 184.5 | 182.0 | 178.0 | 181.0 | 180.0 |

(1) The amount of strain obtained by applying a weight of 500 g to a center is measured using a Handy compression testing machine (manufactured by Katotek Co., Ltd.), Compression velocity: 0.2 mm/second
(2) Variation in amount of strain between an initial load and a final load of the golf ball obtained by applying the initial load of 10 kg and then increasing the load to the final load of 130 kg is measured according to PGA system.
(3) It is measured by hitting with a No.1 wood club at a head speed of about 45 m/second using a Swing robot manufactured by True Temper Co.
(4) It is measured by hitting with a No.5 iron club at a head speed of about 38 m/second using a Swing robot manufactured by True Temper Co.

Examples 5 to 8 and Comparative Examples 4 to 6

Each formulation shown in Table 4 was subjected to compression molding/vulcanization at 155° C. for 20 minutes to form an inner rubber center, respectively. Then, the rubber centers (Examples 5 and 7) and rubber center (Example 6) were coated with an ionomer resin of 0.1 mm in thickness and an ionomer resin of 0.2 mm in thickness, respectively, and then subjected to compression molding to obtain solid centers. Further, the rubber center of Example 8 was coated with a non-vulcanized rubber comprising a formulation shown in Table 2 (thickness: 1 mm), and then subjected to compression molding/vulcanization to obtain a center. Then, a thread wound golf ball with a balata cover was produced using the resulting center. The initial flying performances and the flying performances after 6 months of

TABLE 4

| | Example No. | | | | Comparative Example No. | | |
|---|---|---|---|---|---|---|---|
| | 5 | 6 | 7 | 8 | 4 | 5 | 6 |
| Norsolex *1 | 100 | 100 | 100 | 100 | — | 100 | 100 |
| Sansen 255ZJ *2 | 200 | 200 | 300 | 200 | — | 200 | 300 |
| BR11 *3 | — | — | — | — | 100 | — | — |
| Sulfur | 2 | 2 | 2 | 2 | 10 | 2 | 2 |
| Zinc white | 5 | 5 | 5 | 5 | 5 | 5 | 5 |
| Stearic acid | 2 | 2 | 2 | 2 | 2 | 2 | 2 |
| Barium sulfate | 215 | 220 | 290 | 250 | 95 | 210 | 280 |
| Noxxelar CZ *4 | — | — | — | — | 1.5 | — | — |
| Noxxelar TT *5 | 0.8 | 0.8 | 0.8 | 0.8 | 0.2 | 0.8 | 0.8 |

TABLE 4-continued

| | Example No. | | | | Comparative Example No. | | |
|---|---|---|---|---|---|---|---|
| | 5 | 6 | 7 | 8 | 4 | 5 | 6 |
| Noxxelar M *6 | 0.8 | 0.8 | 0.8 | 0.8 | — | 0.8 | 0.8 |
| Noxxelar TBT-N *7 | 1.2 | 1.2 | 1.2 | 1.2 | — | 1.2 | 1.2 |
| Sanselar TE-G *8 | 0.4 | 0.4 | 0.4 | 0.4 | — | 0.4 | 0.4 |

*1: Trade name, polynorbornene rubber manufactured by Nippon Zeon Co., Ltd.
*2: Trade name, naphthenic oil manufactured by Nihon San Sekiyu Co., Ltd.
*3: Trade name, butadiene rubber manufactured by Japan Synthetic Rubber Co., Ltd.
*4: Trade name, manufactured by Ohuchi Shinko Kagaku Co., Ltd.
*5: Trade name, manufactured by Ohuchi Shinko Kagaku Co., Ltd.
*6: Trade name, manufactured by Ohuchi Shinko Kagaku Co., Ltd.
*7: Trade name, manufactured by Ohuchi Shinko Kagaku Co., Ltd.
*8: Trade name, manufactured by Sanshin Kagaku Co., Ltd.

TABLE 5

| | | | Example No. | | | | Comparative Example No. | | |
|---|---|---|---|---|---|---|---|---|---|
| | | | 5 | 6 | 7 | 8 | 4 | 5 | 6 |
| Ball center | Inner center (mm) | | 28.2 | 28.2 | 28.2 | 26.4 | 28.2 | 28.2 | 28.2 |
| | Outer diameter (mm) | | 28.4 | 28.6 | 28.4 | 28.4 | 28.2 | 28.2 | 28.2 |
| | Weight (g) | | 17.1 | 17.1 | 17.2 | 17.1 | 17.1 | 17.1 | 17.0 |
| | Compression strain (1) (mm) | | 1.2 | 1.0 | 2.4 | 1.7 | 0.4 | 1.4 | 2.5 |
| | Impact resilience (cm) | | 110 | 103 | 106 | 96 | 215 | 125 | 120 |
| Ball | Weight (g) | | 45.5 | 45.3 | 45.2 | 45.3 | 45.4 | 45.3 | 45.4 |
| | Compression (2) | Beginning | 90 | 90 | 90 | 90 | 90 | 90 | 90 |
| | | After 6 months | 90 | 90 | 90 | 90 | 90 | 87 | 86 |
| Flying performances 1 | Launch angle (°) (3) | Beginning | 10.8 | 10.6 | 11.0 | 11.1 | 9.5 | 11.2 | 11.3 |
| | | After 6 months | 10.8 | 10.7 | 11.1 | 11.2 | 9.6 | 10.5 | 10.3 |
| | Spin (rpm) (3) | Beginning | 3450 | 3500 | 3420 | 3400 | 3900 | 3400 | 3380 |
| | | After 6 months | 3500 | 3580 | 3460 | 3450 | 3980 | 3750 | 3700 |
| | Carry (yard) (3) | Beginning | 216 | 216.5 | 216.5 | 217.0 | 210 | 216.0 | 216.5 |
| | | After 6 months | 217 | 216.5 | 217.0 | 217.5 | 211 | 214.0 | 213.5 |
| | Total (yard) (3) | Beginning | 223 | 223.0 | 223.5 | 224.0 | 214 | 223.0 | 223.0 |
| | | After 6 months | 224.5 | 224.0 | 224.0 | 224.5 | 215 | 220.0 | 219.5 |
| Flying performances 2 | Launch angle (°) (4) | Beginning | 13.5 | 13.3 | 13.8 | 13.61 | 12.5 | 13.8 | 13.9 |
| | | After 6 months | 13.7 | 13.4 | 13.9 | 13.7 | 12.4 | 13.0 | 12.8 |
| | Spin (rpm) (4) | Beginning | 4500 | 4600 | 4450 | 4550 | 5500 | 4550 | 4480 |
| | | After 6 months | 4450 | 4540 | 4420 | 4470 | 5400 | 4850 | 4900 |
| ances | Carry (yard) (4) | Beginning | 172 | 171.5 | 172.0 | 172.0 | 165 | 171.5 | 172.0 |
| | | After 6 months | 172.5 | 172.0 | 173.0 | 171.5 | 166.0 | 168.5 | 169.5 |
| | Total (yard) (4) | Beginning | 177 | 176.0 | 176.5 | 177.0 | 168 | 176.0 | 176.0 |
| | | After 6 months | 176.5 | 176.0 | 177.0 | 177.5 | 167.5 | 173.5 | 174.0 |

(1) The amount of strain obtained by applying a weight of 500 g to a center is measured using a Handy compression testing machine (manufactured by Katotek Co., Ltd.), Compression velocity: 0.2 mm/second
(2) Variation in amount of strain between an initial load and a final load of the golf ball obtained by applying the initial load of 10 kg and then increasing the load to the final load of 130 kg is measured according to PGA system.
(3) It is measured by hitting with a No.1 wood club at a head speed of about 45 m/second using a Swing robot manufactured by True Temper Co.
(4) It is measured by hitting with a No.5 iron club at a head speed of about 38 m/second using a Swing robot manufactured by True Temper Co.

As is apparent from the above results, regarding the golf ball having the inner rubber center containing the oily substance among both golf balls with ionomer cover and those with the balata cover, the flying distance was improved due to high launch angle and low spin. Further, regarding the golf balls of Comparative Examples 2, 3, 5 and 6, the compression after 6 months is 3 to 5 point lower than the initial compression, and the launch angle became small and the spin became large. On the other hand, regarding the golf balls of Examples 1 to 4 and 5 to 8, no change was observed in the compression, and no change was observed in both launch angle and spin in comparison with the initial performances.

Further, feeling and control properties were confirmed according to a practical hitting test by a professional golfer. As a result, it is evaluated that all of the golf balls of the above Examples have excellent hit feeling and control properties.

What is claimed is:

1. A thread wound golf ball comprising a solid center, a thread rubber layer provided on the outside of the solid center and a cover for covering the thread rubber layer, wherein said center has a strain of 0.5 to 5 mm when 500 g weight is loaded on the solid center and is composed of an inner rubber portion and an oil-resistant substance covering the inner rubber portion, and said inner rubber portion has a crosslinked rubber structure, formed from a rubber composition comprising 100 parts by weight of a base rubber and 30 to 500 parts by weight of an oily substance, whereby bleeding of the oily substance is prevented.

2. The thread wound golf ball according to claim 1 wherein said inner rubber portion is prepared by press-molding a rubber composition containing a relatively large amount of an oily substance.

3. The thread wound golf ball according to claim 2 wherein said oily substance is selected from the group consisting of petroleum compounded oil, plasticizer, rubber substitute, alkylbenzene, liquid rubber and a mixture thereof.

4. The thread wound golf ball according to claim 1 wherein said base rubber is selected from the group consisting of polybutadiene rubber, natural rubber, ethylene-propylene-diene monomer terpolymer rubber, polynorbornene rubber, a thermoplastic rubber and a mixture thereof.

5. The thread wound golf ball according to claim 1 wherein said oil-resistant substance is selected from the group consisting of ionomer resin, acrylonitrile-butadiene rubber, chloroprene rubber, urethane rubber, fluorosilicone rubber and a mixture thereof.

6. The thread wound golf ball according to claim 1 wherein said oil-resistant substance has a thickness of 0.01 to 5 mm.

7. The thread wound golf ball according to claim 1 wherein said cover covering the thread wound center is made from an ionomer resin or a balata.

8. A thread wound golf ball comprising a solid center, a thread rubber layer provided on the outside of the solid center and a cover for covering the thread rubber layer, wherein said center has a strain of 0.5 to 5 mm when 500 g weight is loaded on the solid center and is composed of an inner rubber portion and an oil-resistant substance covering the inner rubber portion, and said inner rubber portion has a crosslinked rubber structure, formed from a composition comprising 100 parts by weight of a base rubber and 30 to 500 parts by weight of an oily substance, whereby bleeding of the oily substance is prevented, wherein said oily substance is selected from the group consisting of petroleum compounded oil, plasticizer, rubber substitute, alkylbenzene, liquid rubber and a mixture thereof; and wherein said oil-resistant substance is selected from the group consisting of ionomer resin, acrylonitrile-butadiene rubber, chloroprene rubber, urethane rubber, fluorosilicone rubber and a mixture thereof.

* * * * *